US007072442B1

(12) United States Patent
Janik

(10) Patent No.: US 7,072,442 B1
(45) Date of Patent: Jul. 4, 2006

(54) X-RAY METROLOGY USING A TRANSMISSIVE X-RAY OPTICAL ELEMENT

(75) Inventor: Gary R. Janik, Palo Alto, CA (US)

(73) Assignee: KLA-Tencor Technologies Corporation, Milpitas, CA (US)

( * ) Notice: Subject to any disclaimer, the term of this patent is extended or adjusted under 35 U.S.C. 154(b) by 164 days.

(21) Appl. No.: 10/300,107

(22) Filed: Nov. 20, 2002

(51) Int. Cl.
*G21K 1/06* (2006.01)

(52) U.S. Cl. ..... 378/84; 378/85; 378/145

(58) Field of Classification Search ..... 378/43, 378/70, 71, 50, 84–90, 54, 98.8, 147, 145, 378/45; 359/19, 565, 742; 250/505.1, 306
See application file for complete search history.

(56) References Cited

U.S. PATENT DOCUMENTS 5,071,207 A * 12/1991 Ceglio et al. ..... 359/15
5,222,113 A * 6/1993 Thieme et al. ..... 378/43
5,315,113 A * 5/1994 Larson et al. ..... 250/305
5,594,773 A * 1/1997 Tomie ..... 378/145
5,619,548 A 4/1997 Koppel
5,834,767 A * 11/1998 Hasegawa et al. ..... 250/237 G
5,914,998 A * 6/1999 Izumi ..... 378/84
6,167,112 A * 12/2000 Schneider ..... 378/43
6,226,349 B1 * 5/2001 Schuster et al. ..... 378/84
6,327,335 B1 * 12/2001 Carroll ..... 378/85
6,381,303 B1 * 4/2002 Vu et al. ..... 378/46
6,556,652 B1 * 4/2003 Mazor et al. ..... 378/86

OTHER PUBLICATIONS

Publication entitled: "A Compound Refractive Lens For Focusing High-Energy X-Rays", Snigirev et al.; Nature; vol. 384; Nov. 7, 1996; pp. 49-51.
Publication entitled: "Focusing High-Energy X-Rays By Compound Refractive Lenses", Snigirev et al.; Applied Optics; vol. 37; No. 4; Feb. 1, 1998; pp. 653-662.
Publication entitled: "Design And Fabrication Of Fresnel Zone Plates With Large Numbers Of Zones", Chen et al.; 1997 American Vacuum Society; J. Vac. Sci. Technol. B 15(6), Nov./Dec. 1997; pp. 2522-2527.

(Continued)

*Primary Examiner*—Edward J. Glick
*Assistant Examiner*—Irakli Kiknadze
(74) *Attorney, Agent, or Firm*—Bever, Hoffman & Harms, LLP; Jeanette S. Harms

(57) ABSTRACT

An x-ray metrology system includes one or more transmissive x-ray optical elements, such as zone plates or compound refractive x-ray lenses, to shape the x-ray beams used in the measurement operations. Each transmissive x-ray optical element can focus or collimate a source x-ray beam onto a test sample. Another transmissive x-ray optical element can be used to focus reflected or scattered x-rays onto a detector to enhance the resolving capabilities of the system. The compact geometry of transmissive x-ray optical element allows for more flexible placement and positioning than would be feasible with conventional curved crystal reflectors. For example, multiple x-ray beams can be focused onto a test sample using a transmissive x-ray optical element array. Robust zone plates can be efficiently produced using a damascene process.

12 Claims, 12 Drawing Sheets

OTHER PUBLICATIONS

Publication entitled: "X-Ray Multilevel Zone Plate Fabrication By Means Of Electron-Beam Lithography: Toward High-Efficiency Performances", Di Fabrizio et al.; 1999 American Vacuum Society; J. Vac. Sci. Technol. B 17(6), Nov./Dec. 1999; pp. 3439-3443.

Publication entitled: "Phase Zone Plates For X-Rays And The Extreme UV", Janos Kirz; Journal Of The Optical Society of America; vol. 64; No. 3; Mar. 1974; pp. 301-309.

* cited by examiner

X-RAY METROLOGY USING A TRANSMISSIVE X-RAY OPTICAL ELEMENT

FIELD OF THE INVENTION

This invention relates generally to metrology tools, and more particularly to a system and method for using transmissive x-ray optical elements to perform x-ray measurements.

BACKGROUND OF THE INVENTION

X-ray metrology systems are often used to measure and characterize small and/or hidden features in various materials. For example, thin film thickness measurement systems often use a technique known as x-ray reflectometry (XRR), which measures the interference patterns created by reflection of x-rays off a thin film. FIG. 1*a* shows a conventional x-ray reflectometry system 100, as described in U.S. Pat. No. 5,619,548, issued Apr. 8, 1997 to Koppel. X-ray reflectometry system 100 comprises a microfocus x-ray tube 110, an x-ray reflector 120, a detector 130, and a stage 140. A test sample 142 having a thin film layer 141 is held in place by stage 140 for the measurement process.

To measure the thickness of thin film layer 141, microfocus x-ray tube 110 directs a source x-ray beam 150 at x-ray reflector 120. Source x-ray beam 150 actually comprises a bundle of diverging x-rays, including x-rays 151 and 152. X-ray reflector 120 reflects and focuses the diverging x-rays of x-ray beam 150 into a converging x-ray beam 160. Converging x-ray beam 160 includes x-rays 161 and 162, which correspond to x-rays 151 and 152, respectively. Converging x-ray beam 160 is then reflected by thin film layer 141 as an output x-ray beam 170 onto detector 130. Output x-ray beam 170 includes reflected x-rays 171 and 172, which correspond to x-rays 161 and 162, respectively.

The reflected x-rays in output x-ray beam 170 are actually formed by reflections at both the surface of thin film layer 141 and at the interface between thin film layer 141 and test sample 142. Detector 130 measures the resulting constructive and destructive interference between the reflected x-rays in output x-ray beam 170 as a reflectivity curve. An example reflectivity curve is shown in FIG. 2. By measuring the fringes in the reflectivity curve, the thickness of thin film layer 141 can be determined, as described in U.S. Pat. No. 5,619,548.

To ensure accurate measurements in any x-ray metrology system, precise x-ray beam shaping within the system is critical. Due to the small dimensions being measured by x-ray metrology systems, any x-ray beams used within such system must be tightly controlled (e.g., focused, collimated, etc.). Therefore, a critical component in many conventional x-ray metrology systems (such as XRR system 100 shown in FIG. 1*a*) is an x-ray reflector that focuses the x-ray beam onto the sample being measured. An x-ray reflector (such as x-ray reflector 120 shown in FIG. 1*a*) is typically a doubly curved crystal formed using high-precision machining and grinding operations. This manufacturing process is very time consuming and expensive. Furthermore, incorporation of a doubly curved crystal into an x-ray metrology system requires large crystal mounts that make the incorporation of multiple crystals into a single tool very difficult.

Accordingly, it is desirable to provide a system and method for performing x-ray metrology without using crystal reflectors as a focusing mechanism.

SUMMARY OF THE INVENTION

The invention provides a method and system for performing x-ray metrology using transmissive x-ray optical elements as beam-shaping elements. For example, a zone plate is a type of transmissive x-ray optical element that comprises a set of concentric metal rings formed on a substrate—essentially a diffraction grating configured to work on x-rays. The beam-shaping properties of a zone plate are defined by the size, shape, and spacing of the metal rings. Because the beam-shaping properties of a zone plate is based upon diffraction, a zone plate can have a much flatter geometry than a curved crystal, which provides beam shaping via reflection. As described by Janoz Kirz in "Phase Zone Plates for X-Rays and the Extreme UV" (*Journal of the Optical Society of America*, Vol. 64, No. 3, March 1974, pp. 301–309.), phase reversal zone plates can be used for beam shaping in x-ray astronomy and spectroscopy.

Another type of transmissive x-ray optical element, a compound refractive x-ray lens, includes a series of curved structures, each of which acts as a refracting element for an incoming x-ray beam. While the index of refraction of most materials at x-ray energies is very small, the use of many refracting elements in series allows a compound refractive x-ray lens to provide x-ray beam reshaping in a relatively compact form. For example, a compound refractive x-ray lens can be constructed by forming an alternating series of horizontal and vertical holes in a block comprising a low atomic number material (e.g., aluminum, silicon, boron-nitride, diamond, lithium, beryllium, etc.), as described by A. Snigirev et al. in "A Compound Refractive Lens For Focusing High Energy X Rays," (*Nature*, vol. 384, Nov. 7, 1996, pp. 49–51.), herein incorporated by reference. The resulting curved (cylindrical) surfaces within the block form a series of refracting elements that can focus an x-ray beam travelling through the block. Compound refractive x-ray lenses can also be fabricated using semiconductor lithography and etch techniques or by forming thin metal foils into appropriate curved configurations. Various other methods for constructing compound refractive x-ray lenses are discussed by A. Snigirev et al. in "Focusing High Energy X-Rays by Compound Refractive Lenses," (*Applied Optics*, vol. 37, no. 4, Feb. 1, 1998, pp. 653–662.).

By incorporating transmissive x-ray optical elements into x-ray metrology systems, the invention advantageously eliminates the need for fragile and expensive crystal reflectors. In addition, transmissive x-ray optical elements are much easier to support and position within an x-ray metrology system (since they do not require the large crystal mounts used by curved crystal reflectors). Therefore, transmissive x-ray optical element provide flexible placement and positioning options, including the use of multiple transmissive x-ray optical elements in series or arrays. Transmissive x-ray optical elements are also capable of focusing x-rays to much smaller spots than curved crystals, thereby enabling the measurement of much smaller spots on test samples.

According to an embodiment of the invention, a transmissive x-ray optical element can be used to focus an x-ray beam onto a test sample. An optional order-blocking filter can be used to prevent any unwanted x-rays scattered or diffracted into higher orders by the transmissive x-ray optical element from reaching the test sample. Various x-ray metrology operations can be performed using such a focused beam, including x-ray reflectometry (XRR) and x-ray diffraction (XRD).

According to another embodiment of the invention, multiple transmissive x-ray optical elements in series can be used to perform the focusing operation. In this implementation, the total numerical aperture (NA) of the system can be advantageously increased without increasing the overall diameter of the transmissive x-ray optical element. According to another embodiment of the invention, x-rays generated (e.g., reflected or scattered from the test sample) by the focused beam incident on the test sample can be focused onto a detector by a transmissive x-ray optical element (or transmissive x-ray optical elements), thereby increasing the resolving power of the x-ray metrology system without increasing the system footprint. According to another embodiment of the invention, multiple transmissive x-ray optical elements in an array can be used to focus multiple x-ray beams onto the test sample to enable simultaneous measurement of data from multiple incident x-ray beam angles. According to another embodiment of the invention, a transmissive x-ray optical element can be used to collimate and direct an x-ray beam onto a test sample to perform small angle x-ray scattering (SAXS).

The invention also provides an improved method for producing zone plates for use in x-ray applications by using standard damascene processing techniques used in integrated circuit (IC) interconnect fabrication. Conventional zone plate production methods involve patterning a substrate using electron beam lithography and deep reactive ion etching and then using multi-level electro-chemical plating to form the final diffraction grating, as described by Chen et al. in "Design and Fabrication of Fresnel Zone Plates With Large Numbers of Zones" (Journal of Vacuum Science Technology, B 15(6), Nov./December 1997, pp. 2522–2527.) and by Fabrizio et al. in "X-Ray Multilevel Zone Plate Fabrication by Means of Electron-Beam Lithography: Toward High-Efficiency Performances" (Journal of Vacuum Science Technology, B 17(6), Nov./December 1999, pp. 3439–3443.). Unfortunately, these conventional zone plate fabrication methods result in very high aspect ratio unsupported metal structures, which are very fragile and difficult to reliably produce.

According to an embodiment of the invention, a zone plate can be manufactured using a damascene process by forming a stack of damascene layers. Each damascene layer can be formed by patterning circular trenches in a dielectric material, depositing a metal seed layer over the patterned surface by physical vapor deposition (PVD), electro-chemically plating onto this seed layer, and then planarizing the top layer of metal to leave an exposed pattern of alternating rings of metal and dielectric material. Intermediate layers of dielectric material can be used to separate the damascene layers. By constructing a zone plate in this staged manner, the problematic high aspect ratio structures required by conventional manufacturing processes can be avoided. Not only does this simplify the manufacture of zone plates, but the zone plates produced using this technique would generally be more robust than conventionally formed zone plates. Furthermore, the actual beam shaping performance of such zone plates can be optimized by tailoring the metal ring widths and thicknesses in individual layers of the zone plate to maximize diffraction efficiency into the desired first order wavelength and cancel out higher diffraction into the unwanted higher order wavelengths.

The present invention will be more fully understood in view of the following description and drawings.

BRIEF DESCRIPTION OF THE DRAWINGS

These and other features, aspects and advantages of the present invention will become better understood with regard to the following description, appended claims, and accompanying drawings.

DETAILED DESCRIPTION

Figure 3A:
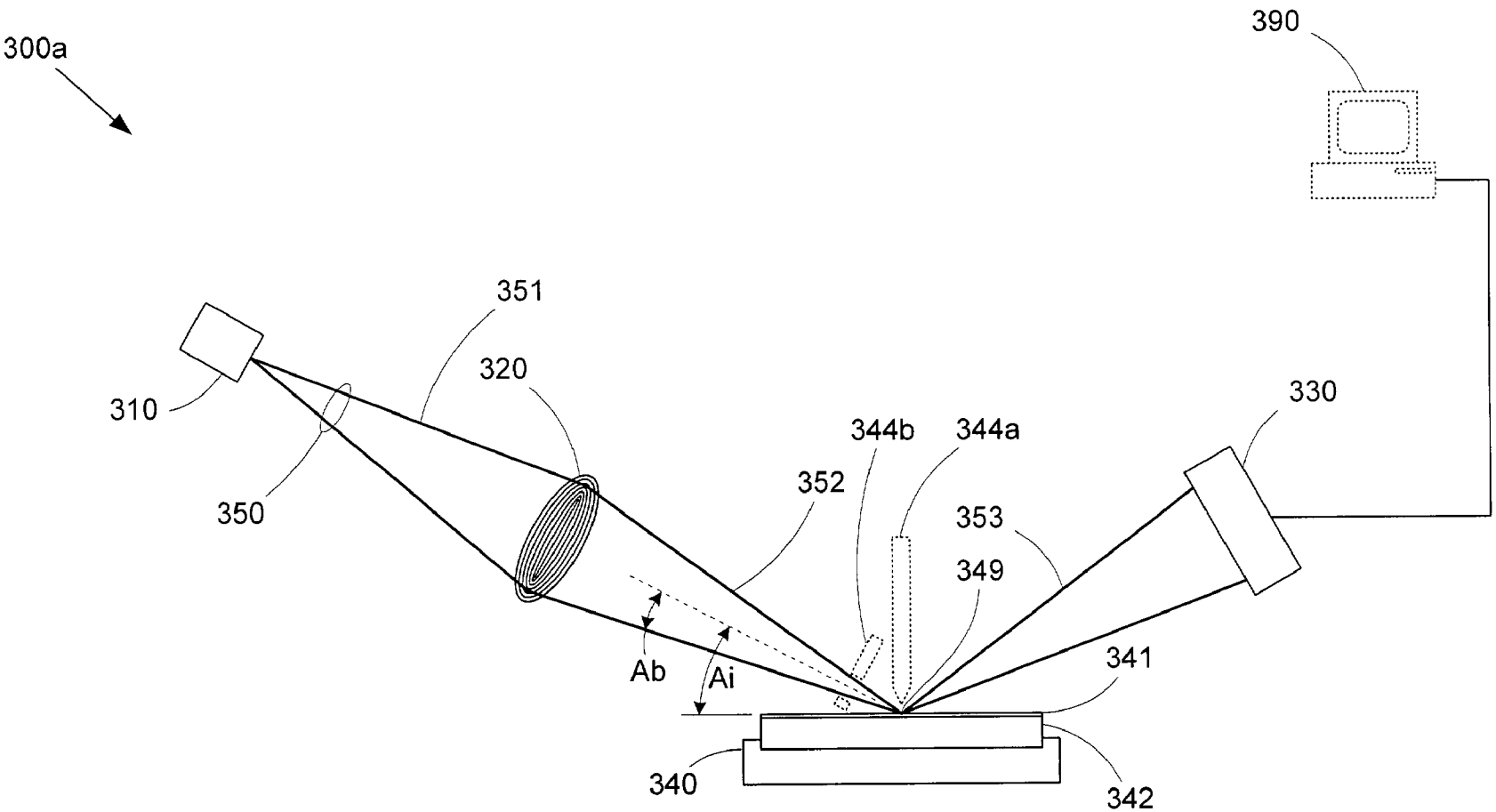
FIG. 3*a* is a schematic diagram of an x-ray metrology system incorporating a transmissive x-ray optical element in accordance with an embodiment of the invention.

FIG. 3*a* shows an x-ray metrology system 300*a* in accordance with an embodiment of the invention. X-ray metrology system 300*a* includes an x-ray source 310, a transmissive x-ray optical element 320, a stage 340 for supporting a test sample 342, a detector 330, optional order blocking filters 344*a* and 344*b*, and an optional computer 390. Transmissive x-ray optical element 330 can comprise any x-ray beam reshaping element that operates via transmission of x-rays, such as a zone plate or compound refractive x-ray lens. As described above, a zone plate comprises a set of concentric metal rings that provide x-ray beam shaping via diffraction, with the actual beam shaping properties being determined by the size, shape, and spacing of the concentric metal rings. Note that the relatively flat geometry of a zone plate or compound refractive x-ray lens can provide substantial placement and positioning flexibility within x-ray metrology system 300*a*.

During a metrology operation, x-ray source 310 generates an x-ray beam 350 that comprises a set of diverging x-rays, as indicated by a diverging beam portion 351. According to an embodiment of the invention, x-ray source 310 can comprise a microfocus x-ray tube. According to other embodiments of the invention, x-ray source 310 can comprise a laser-plasma or dense plasma source, or a high current capillary discharge source. Transmissive x-ray optical element 320 intercepts beam portion 351 and reshapes it into a converging beam portion 352 focused onto a measurement spot 349 on a thin film layer 341 on test sample 342. Optional order blocking filter 344 can be positioned above measurement spot 349 to define an opening through which only the focused x-rays of beam portion 352 can pass. Any x-rays scattered or diffracted into non-first order frequencies by transmissive x-ray optical element 320 would then be blocked by order blocking filter 344*a*. According to another embodiment of the invention, optional order blocking filter 344*b* can include an aperture placed directly in the path of beam portion 352 to provide a similar filtering effect. Order blocking filters 344*a* and 344*b* can comprise any material that is opaque to the x-rays generated by x-ray source 310.

Note that the beam shaping characteristics and position of transmissive x-ray optical element 320 can be selected based on the design parameters of x-ray metrology system 300*a*, such as the specific metrology operation being performed, desired system footprint, measurement spot size, and measurement throughput. For example, to perform x-ray reflectometry (XRR), transmissive x-ray optical element 320 could be selected to be a zone plate producing a first order diffraction of the x-rays in beam portion 351 that focuses beam portion 352 into a spot no larger than 1 μm (diameter) at a focal point 300 mm from transmissive x-ray optical element 320. Similarly, transmissive x-ray optical element 320 could comprise a compound refractive x-ray lens that refracts the x-rays in beam portion 351 into a similar beam portion 352. Transmissive x-ray optical element 320 could then be positioned two focal lengths (i.e., 2×150 mm) from both x-ray source 310 and measurement spot 349, to form a 1:1 imaging system, such that beam portion 352 takes the shape of a cone having a half angle Ab roughly equal to 0.03° and incident to test sample 342 at an incident angle Ai roughly equal to 0.2°. Note that while beam portion 352 as a whole has an incident angle Ai with thin film layer 341, the individual x-rays (not shown for clarity) beam portion 352 have a variety of different incident angles with thin film layer 341. Those individual x-rays are then reflected across a corresponding range of reflected angles, thereby forming an output beam portion 353, which is measured by detector 330.

Depending on the type of x-ray metrology process being performed, detector 330 can comprise various detector elements. For example, to measure reflectivity curves for x-ray reflectometry (XRR) or diffraction patterns for x-ray diffraction (XRD), detector 330 can comprise a position-sensitive charge-coupled device (CCD) sensor (linear array or 2-dimensional), photodiode array, or image plate, among others. By simulatneously detecting reflected x-rays from incident x-rays having a variety of incident angles, the position sensitive detector provides measurements that can then be stored or processed by computer 390 to determine thin film properties associated with test sample 342. Note that thin film layer 341 can comprise various materials, including metal, dielectric, and semiconducting, and the measured film properties can include film thickness, density, roughness, and composition, among others. Furthermore, thin film layer 341 can even comprise multiple layers which can be simultaneously measured (e.g., simultaneous measurement of the thickness for each layer).

Figure 9:
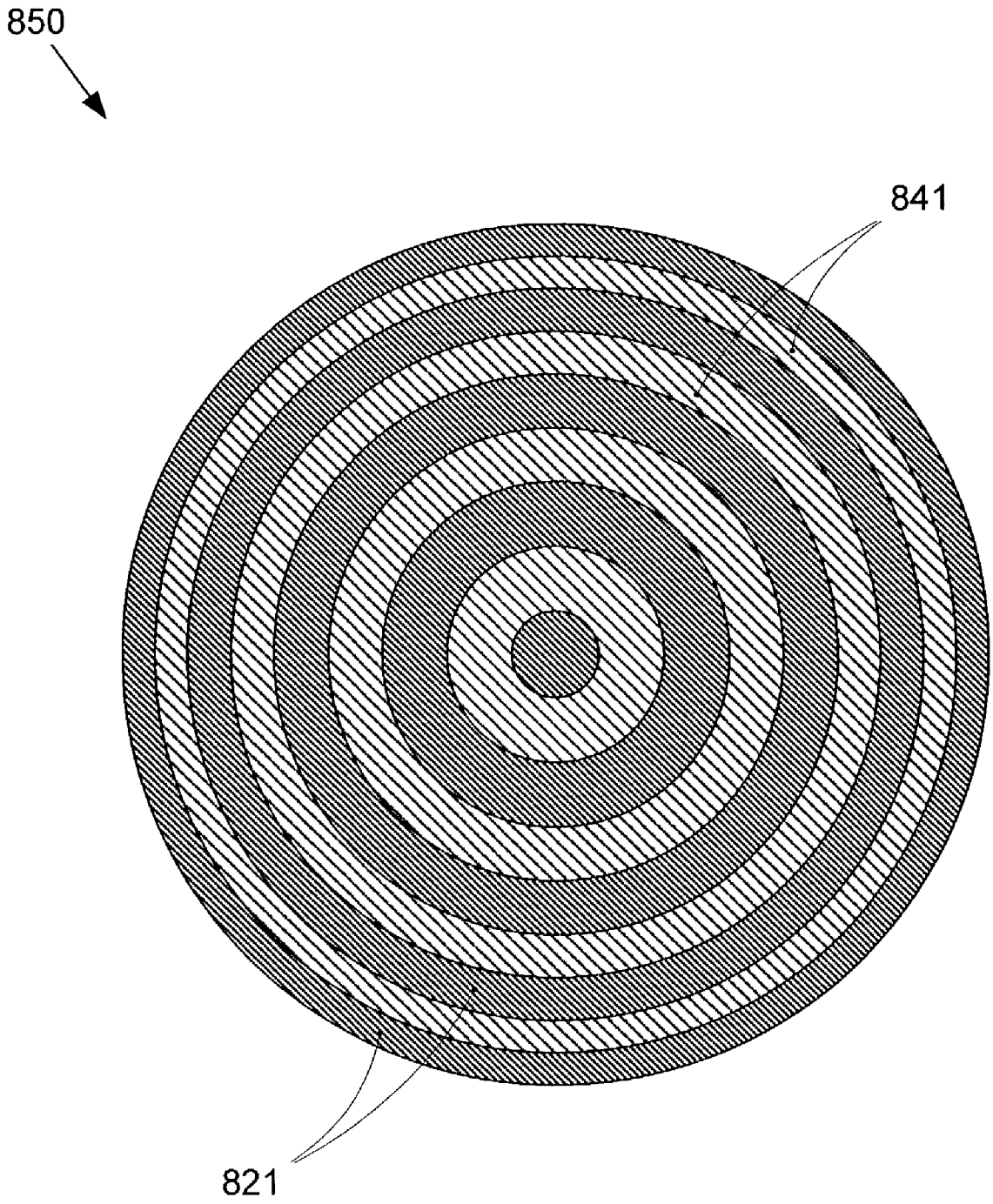
FIG. 9 is a top view of a damascene layer shown in FIG. 8*h*, according to an embodiment of the invention.

As is described below with respect to FIG. 9, a zone plate includes concentric rings of a first material formed in a second material. The zone plate material diffracts the incident x-rays to reshape the incident x-ray beam into a desired form. By properly sizing the concentric rings (according to the characteristics of the incident x-ray beam and the properties of the first material and the second material) the x-rays in the x-ray beam exiting from the zone plate can be made to constructively interfere, thereby ensuring a strong output signal. Note that a compound refractive x-ray element can likewise be optimized to ensure a strong output signal.

The specific configuration and positioning of transmissive optical element 320 can be adjusted depending on the particular requirements of the measurement operation being performed. For example, an XRR operation could incorporate a zone plate or compound refractive x-ray lens configured as described above (i.e., producing a cone of x-rays having a half angle Ab equal to roughly 0.03° and an incident angle Ai roughly equal to 0.2°). For XRD measurements, larger values for the incident angle Ai could be used. Note that while a focusing operation is depicted in FIG. 3*a* for explanatory purposes, a transmissive x-ray optical element can provide any other desired beam shaping, such as collimating (as described below with respect to FIG. 7).

Figure 1:
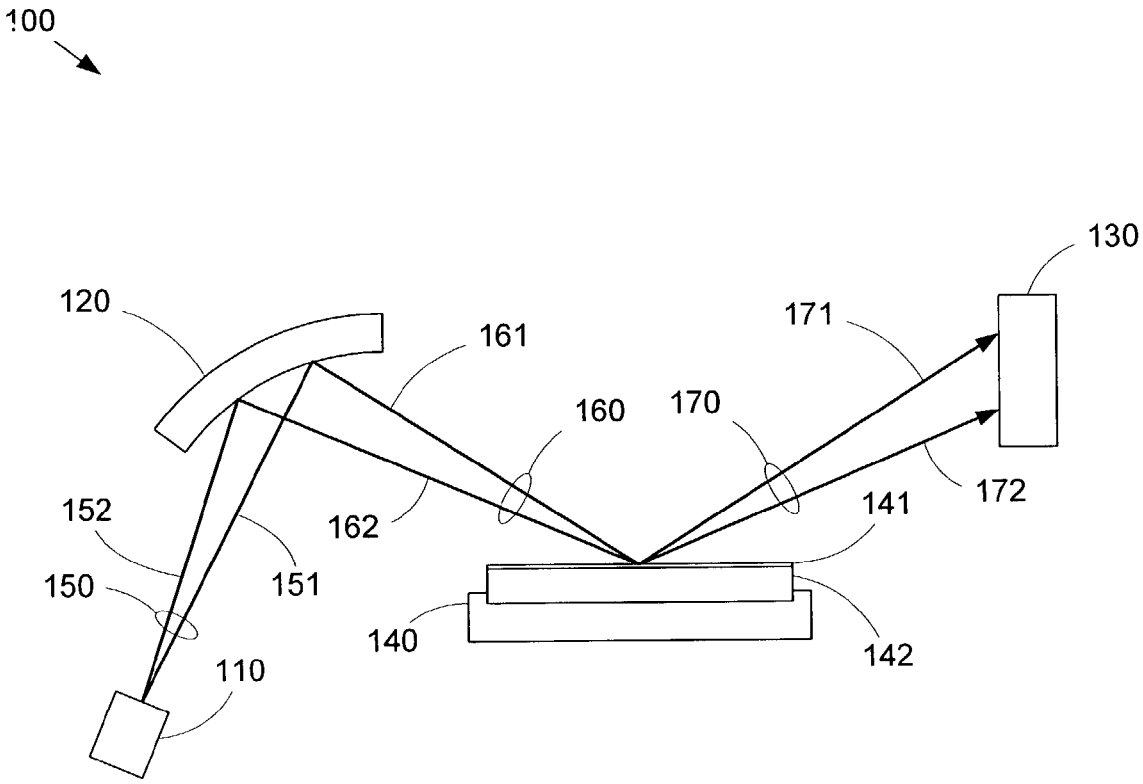
Fig. 1 (PRIOR ART)
FIG. 1 is a schematic diagram of a conventional x-ray reflectometry system.
Figure 2:
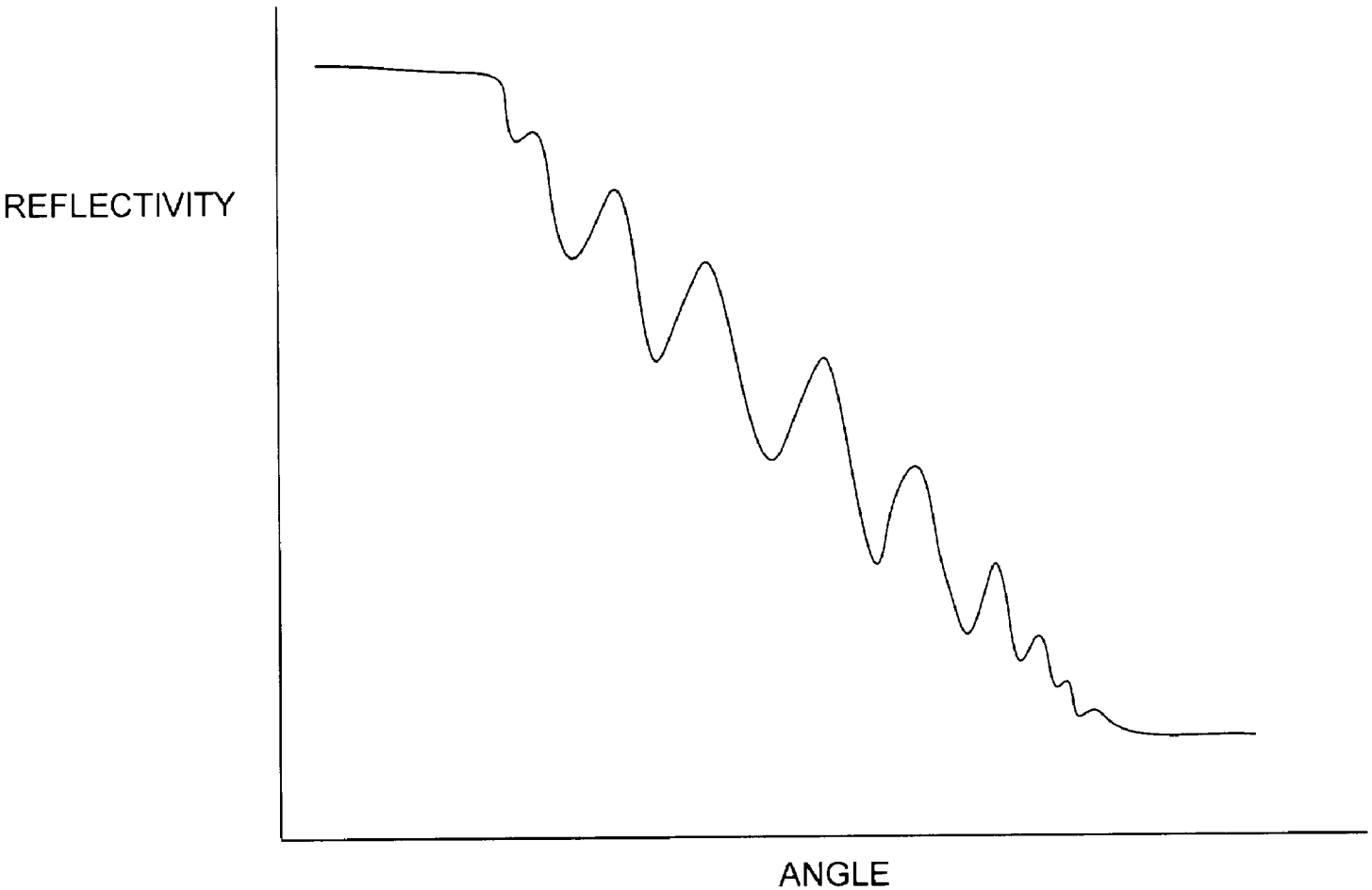
FIG. 2 is an example of a reflectivity curve.
Figure 3B:
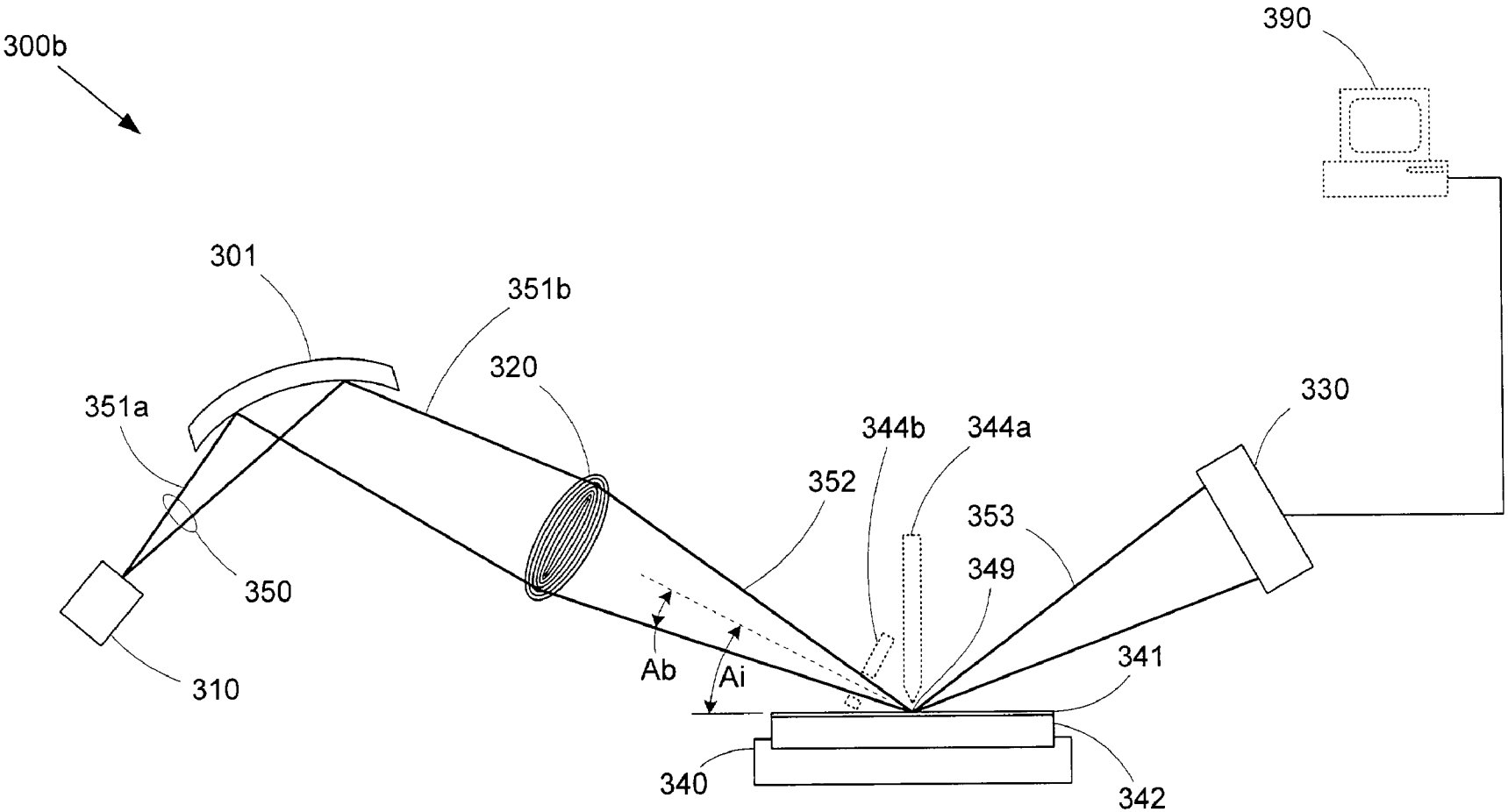
FIG. 3*b* is a schematic diagram of an x-ray metrology system incorporating a transmissive x-ray optical element and a reflective x-ray optical element in accordance with an embodiment of the invention.

Note further that according to other embodiments of the invention, transmissive x-ray optical elements can be used in conjunction with reflective x-ray optical elements within an x-ray metrology system. FIG. 3*b* shows an x-ray metrology system 300*b* that is substantially similar to x-ray metrology system 300*a* shown in FIG. 3*a* except that x-ray metrology system 300*b* includes a reflective x-ray optical element 301 (similar to x-ray reflector 120 shown in FIG. 1) in accordance with an embodiment of the invention. Reflective x-ray optical element 301 reflects x-ray beam portion 351*a* onto transmmissive x-ray optical element 320, which then focuses the beam onto thin film layer 341. Various other combinations of reflective and transmissive x-ray optical elements to reshape different portions of an x-ray beam (or beams) in an x-ray metrology system can be incorporated into other embodiments of the invention.

Figure 4:
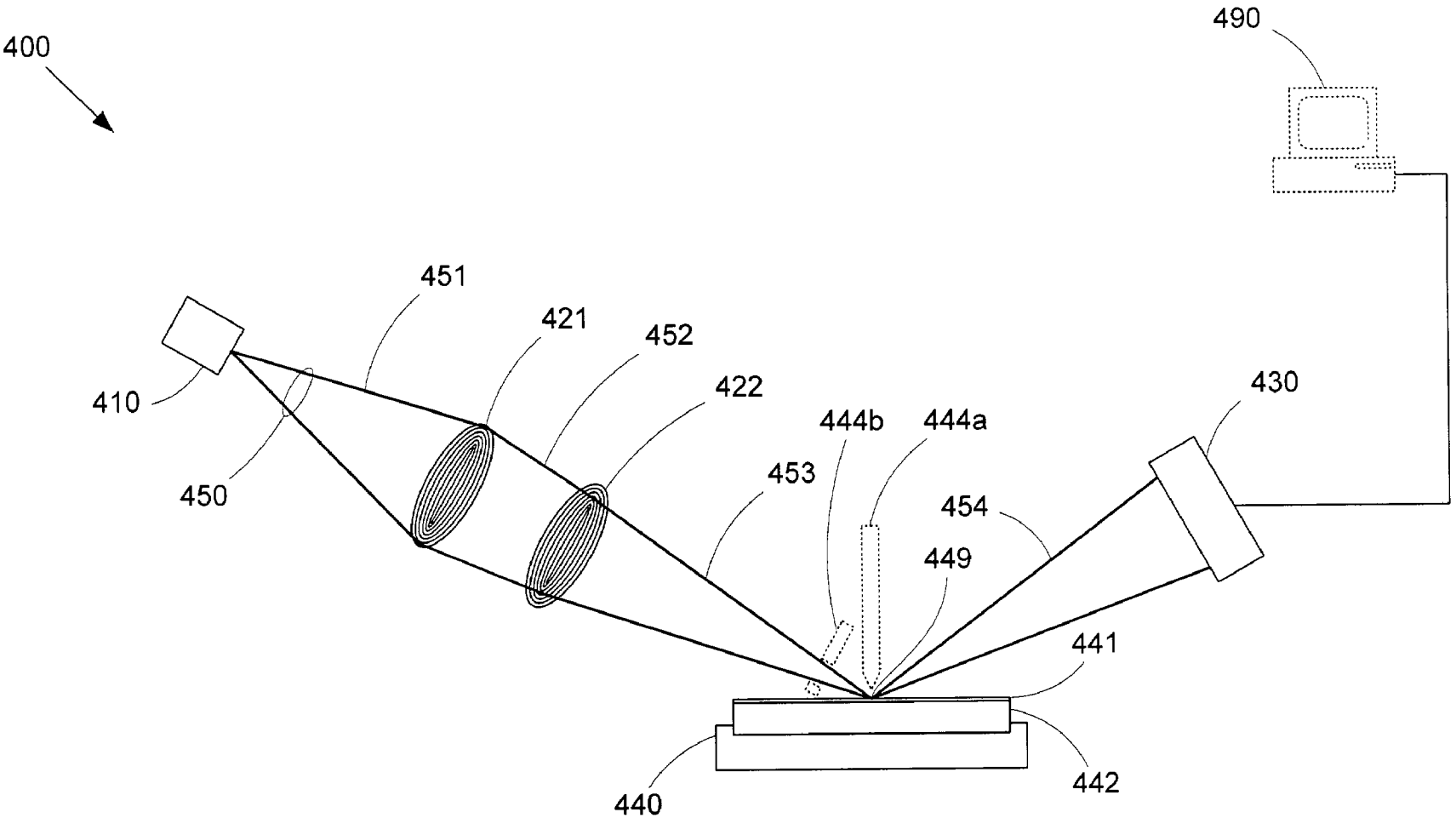
FIG. 4 is a schematic diagram of an x-ray metrology system incorporating multiple transmissive x-ray optical elements in series in accordance with another embodiment of the invention.

To further enhance the measurement capabilities of an x-ray metrology system, multiple transmissive x-ray optical elements can be used. For example, FIG. 4 shows an x-ray metrology system 400 according to another embodiment of the invention. X-ray metrology system 400 includes an x-ray source 410, transmissive x-ray optical elements 421 and 422, a stage 440 for supporting a test sample 442, a detector 430, optional order blocking filters 444*a* and 444*b*, and an optional computer 490. X-ray metrology system 400 is substantially similar to x-ray metrology system 300*a* shown in FIG. 3*a*, except that two transmissive x-ray optical elements are used for focusing the x-ray beam onto the test sample.

During a metrology operation, x-ray source 410 generates an x-ray beam 450 that comprises a set of diverging x-rays, as indicated by an initial beam portion 451. Transmissive x-ray optical element 421 intercepts beam portion 451 and reshapes it into a converging beam portion 452. Transmissive x-ray optical elements 422 further reshapes beam portion 452 into a focused beam portion 453 that is directed onto a measurement spot 449 on a thin film region 441 on test sample 442. Optional order blocking filter 444*a* can be positioned above measurement spot 449 to define an opening through which only the focused x-rays of beam portion 453 can pass. Any x-rays scattered or diffracted into non-first order frequencies by transmissive x-ray optical element 421 and/or 422 would then be blocked by order blocking filter 444*a*. According to another embodiment of the invention, optional order blocking filter 444*b* can include an aperture placed directly in the path of beam portion 453 to provide a similar filtering effect. Order blocking filters 444*a* and 444*b* can comprise any material that is opaque to the x-rays generated by x-ray source 410.

Because the focusing of initial beam portion 451 is performed partially by transmissive x-ray optical element 421 and partially by transmissive x-ray optical element 422, the beam shaping characteristics for each of transmissive x-ray optical elements 421 and 422 can be much more moderate than those of a single transmissive x-ray optical element that independently provides the same focusing behavior. Relatedly, multiple transmissive x-ray optical elements can provide a much larger numerical aperture than a single zone plate of similar diameter, and therefore can be significantly more space-efficient. Note that while two transmissive x-ray optical elements are shown in FIG. 4 for explanatory purposes, according to other embodiments of the invention, any number of transmissive x-ray optical elements could be used to focus initial beam portion 451 onto test sample 442.

Figure 5:
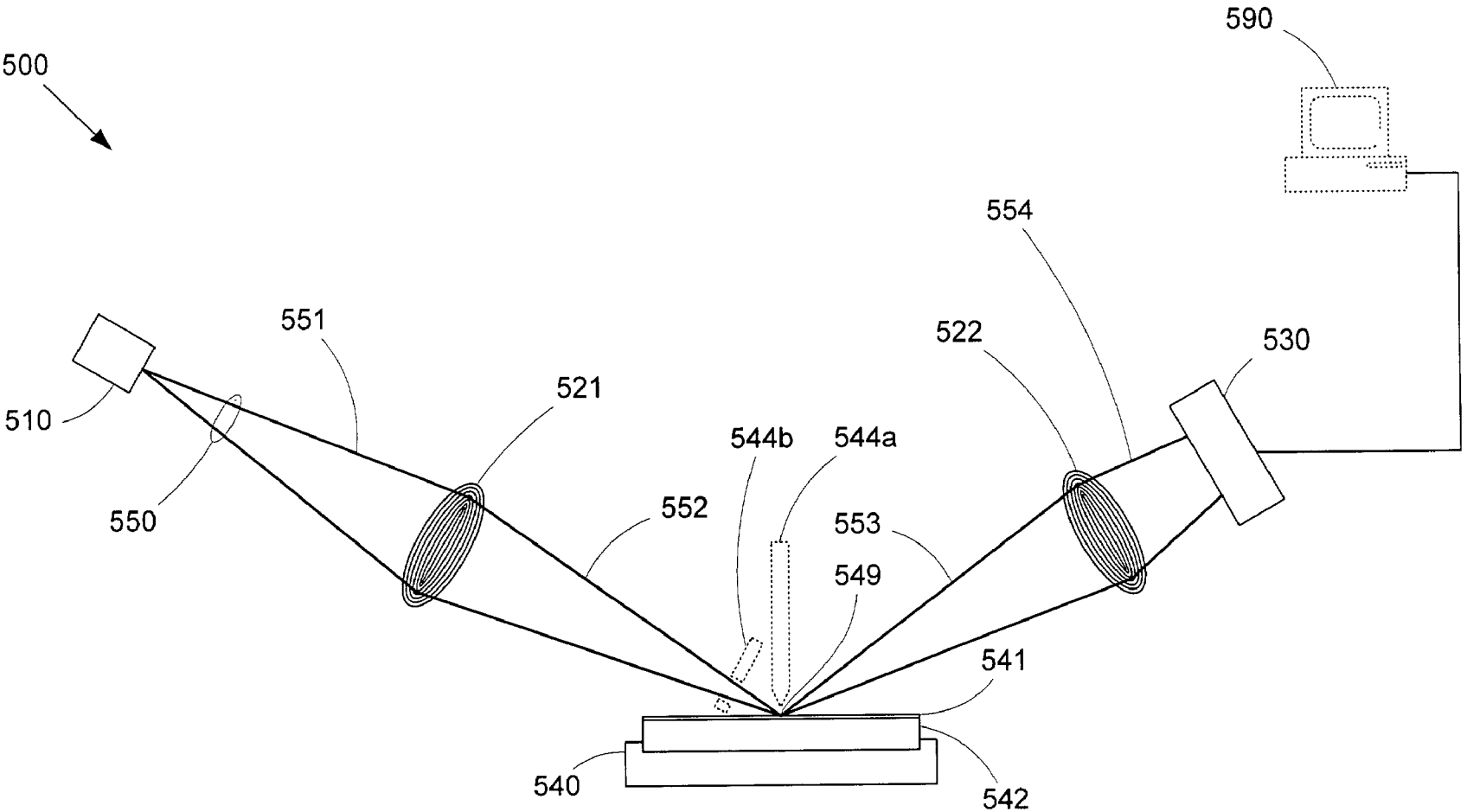
FIG. 5 is a schematic diagram of an x-ray metrology system incorporating multiple transmissive x-ray optical elements in accordance with another embodiment of the invention.

FIG. 5 shows an x-ray metrology system 500 that includes multiple transmissive x-ray optical elements in accordance with another embodiment of the invention. X-ray metrology system 500 includes an x-ray source 510, transmissive x-ray optical elements 521 and 522, a stage 540 for supporting a test sample 542, a detector 530, optional order blocking filters 544*a* and 544*b*, and an optional computer 590. X-ray metrology system 500 is substantially similar to x-ray metrology system 300*a* shown in FIG. 3*a*, except that a second transmissive x-ray optical element is used for focusing the output (reflected) x-ray beam onto the detector.

During a metrology operation, x-ray source 510 generates an x-ray beam 550 that comprises a set of diverging x-rays, as indicated by an initial beam portion 551. Transmissive x-ray optical element 521 intercepts beam portion 551 and reshapes it into a converging beam portion 552 that is directed onto a measurement spot 549 on a thin film region 541 on test sample 542. Optional order blocking filter 544*a* can be positioned above measurement spot 549 to define an opening through which only the focused x-rays of beam portion 552 can pass. Any x-rays scattered or diffracted into non-first order frequencies by transmissive x-ray optical element 521 would then be blocked by order blocking filter 544*a*. According to another embodiment of the invention, optional order blocking filter 544*b* can include an aperture placed directly in the path of beam portion 552 to provide a similar filtering effect. Order blocking filters 544*a* and 544*b* can comprise any material that is opaque to the x-rays generated by x-ray source 510. Beam portion 552 is reflected by test sample 542 as an output beam portion 553. Transmissive x-ray optical element 522 intercepts the diverging x-rays of beam portion 553 and reshapes them into a converging beam portion 554 that is then measured by detector 530. Note that transmissive x-ray optical element 522 does not focus beam portion 553 down to a small spot (in contrast to transmissive x-ray optical element 521), but instead merely reduces the size (diameter) of the beam portion to be measured by detector 530. The measurement data can then be stored or processed by optional computer 590 according to the type of metrology operation being performed.

By reshaping output beam portion 553 in this manner, transmissive x-ray optical element 522 increases the apparent distance between measurement spot 549 and detector 530. This in turn enhances the angular resolution of the measurements taken by detector 530, thereby improving the metrology results. Selecting transmissive x-ray optical element 522 to have a shorter focal length than transmissive x-ray optical element 521 allows x-ray metrology system 500 to be constructed in a space-efficient manner, while positioning detector 530 at the focal point of transmissive x-ray optical element 522 optimizes the resolving power of x-ray metrology system 500. Note that according to various other embodiments of the invention, transmissive x-ray optical element 521 could be replaced by multiple transmissive x-ray optical elements, as described previously with respect to FIG. 4.

Figure 6:
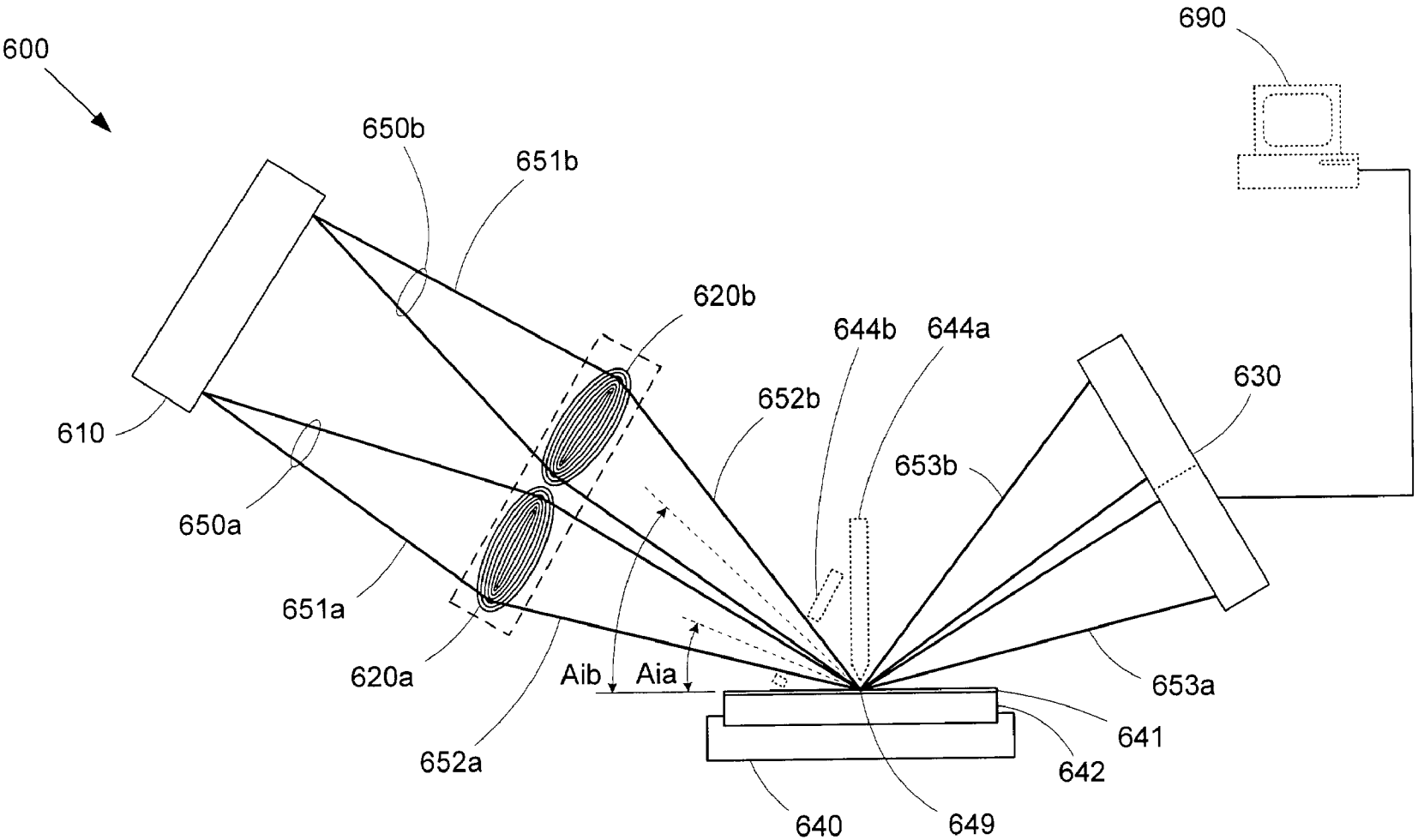
FIG. 6 is a schematic diagram of an x-ray metrology system incorporating multiple x-ray beams and multiple transmissive x-ray optical element in accordance with another embodiment of the invention.

FIG. 6 shows an x-ray metrology system 600 that includes multiple transmissive x-ray optical elements in accordance with another embodiment of the invention. X-ray metrology system 600 includes an x-ray source 610, transmissive x-ray optical elements 620*a* and 620*b*, a stage 640 for supporting a test sample 642, a detector 630, an optional order blocking filter 644, and an optional computer 690. X-ray metrology system 600 is substantially similar to x-ray metrology system 300*a* shown in FIG. 3*a*, except that microfocus x-ray source 610 is configured to provide multiple x-ray beams, and a second transmissive x-ray optical element is used to focus a second x-ray beam onto the test sample.

During a metrology operation, microfocus x-ray source 610 generates x-ray beams 650*a* and 650*b*, each of which comprises a set of diverging x-rays, as indicated by an initial beam portions 651*a* and 651*b*, respectively. According to an embodiment of the invention, microfocus x-ray source 610 comprises a single multi-spot microfocus x-ray tube, wherein a large spot x-ray source is filtered by a multi-hole mask to produce the multiple x-ray beams. According to another embodiment of the invention, microfocus x-ray source 610 comprises multiple single-spot microfocus x-ray tubes. Transmissive x-ray optical element 620*a* intercepts beam portion 651*a* and reshapes it into a converging beam portion 652*a* that is directed onto a measurement spot 649 on a thin film region 641 on test sample 642. Similarly, transmissive x-ray optical element 620*b* intercepts beam portion 651*b* and reshapes it into a converging beam portion 652*b* that is directed at measurement spot 649 on test sample 642. Optional order blocking filter 644*a* can be positioned above measurement spot 649 to define an opening through which only the focused x-rays of beam portions 652*a* and 652*b* can pass. Any x-rays scattered or diffracted into non-first order frequencies by transmissive x-ray optical element 62*a* and 620*b* would then be blocked by order blocking filter 644*a*.

According to another embodiment of the invention, optional order blocking filter 644*b* can include an aperture or apertures placed directly in the paths of beam portion 652*a* and 652*b* to provide a similar filtering effect. Order blocking filters 644*a* and 644*b* can comprise any material that is opaque to the x-rays generated by x-ray source 610. Beam portions 652*a* and 652*b* are reflected by test sample 542 as output beam portions 653*a* and 653*b*, respectively, which are then measured by detector 630.

According to an embodiment of the invention, detector 630 can comprise a single large detector for measuring all output beam portions. According to another embodiment of the invention, detector 630 can comprise a discrete detector for each output beam portion (as indicated by the dotted line). The measurement data can then be stored or processed by optional computer 590 according to the type of metrology operation being performed.

By focusing multiple x-ray beams onto the test sample, measurements for multiple incident beam angles (e.g., incident angles Aia and Aib in FIG. 6) can be taken simultaneously. According to an embodiment of the invention, transmissive x-ray optical elements 620*a* and 620*b* can be formed in a single substrate (as indicated by the dashed lines), thereby improving relative positioning accuracy and simplifying system setup. According to other embodiments of the invention, either or both of transmissive x-ray optical elements 620*a* and 620*b* can be replaced with multiple transmissive x-ray optical elements, as described with respect to FIG. 4. According to other embodiments of the invention, x-ray metrology system 600 can include additional transmissive x-ray optical elements to focus output beam portions 653*a* and 653*b* onto detector 630. Note that while two transmissive x-ray optical elements and two x-ray beams are shown in FIG. 6 for explanatory purposes, according to other embodiments of the invention, any number of transmissive x-ray optical elements and beams can be included in x-ray metrology system 600.

Figure 7:
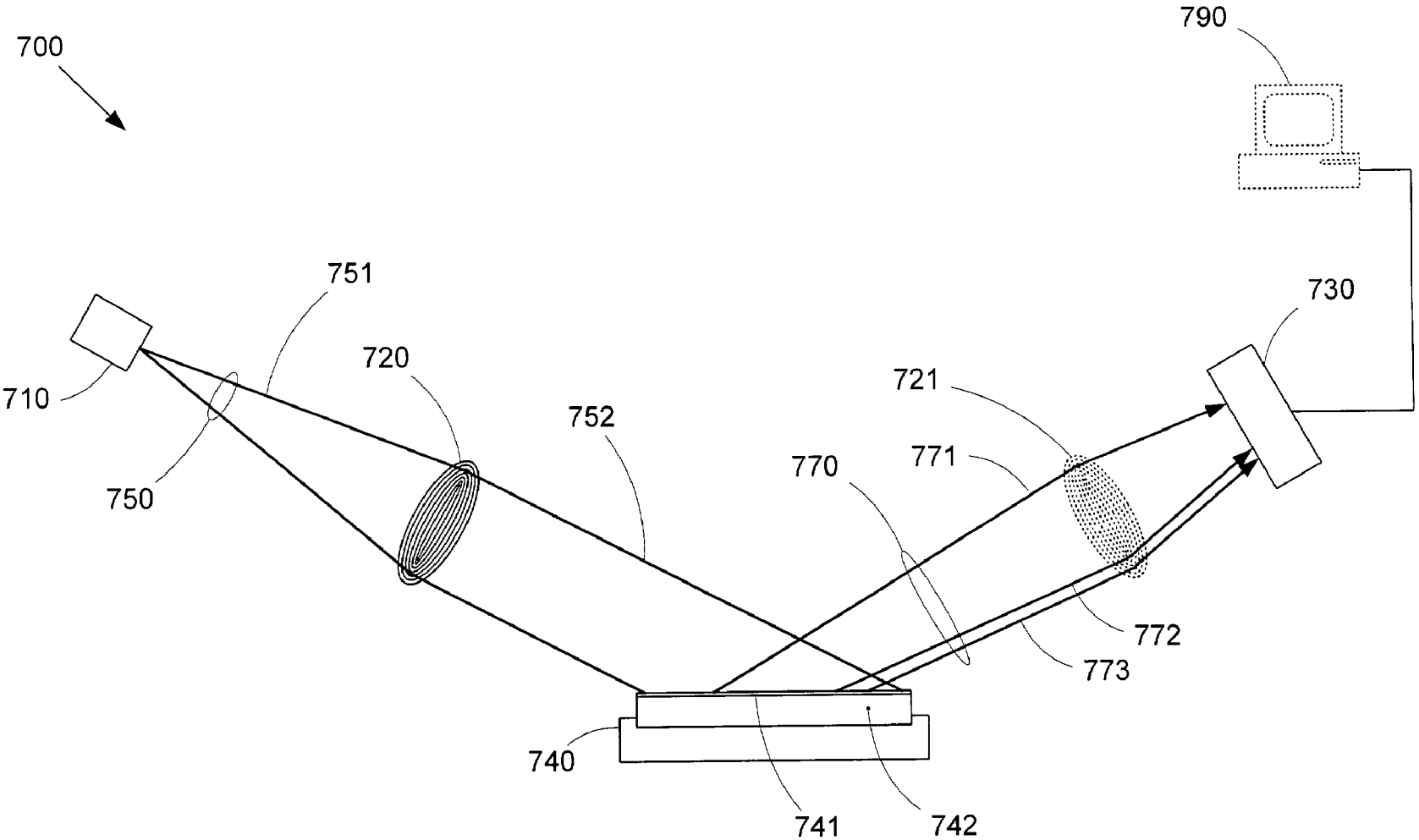
FIG. 7 is a schematic diagram of an x-ray metrology system incorporating multiple transmissive x-ray optical elements in accordance with another embodiment of the invention.

FIG. 7 shows an x-ray metrology system 700 in accordance with another embodiment of the invention. X-ray metrology system 700 is configured to perform small angle x-ray scattering (SAXS) on a test sample 742. Small angle scattering using visible light sources are presently used in areas such as polymer analysis and biological analysis to determine the size (and to some degree the shape) of small particles. A collimated beam of light is directed onto the test sample and the resulting distribution of scattered light rays are analyzed to characterize the structures within the test sample. However, the technique cannot be used for structures that are smaller than the wavelength of the measurement light. For example, dielectric materials for use in semiconductor devices have been proposed that are filled with tiny pores (i.e., porous dielectric material) to reduce the dielectric constant of the material. The pores can be on the order of two nanometers, which is far less than the wavelength of visible light (roughly 400–700 nm), and therefore cannot be resolved by visible light-based techniques. However, such pores can be measured using SAXS, since x-ray wavelengths can be well below the nanometer level.

X-ray metrology system 700 includes an x-ray source 710, a transmissive x-ray optical element 721, a stage 740 for supporting test sample 742, an optional transmissive x-ray optical element 721, a detector 730, and an optional computer 790. As described above with respect to FIG. 3*a*, x-ray source 710 can comprise any x-ray beam-producing component, including a microfocus x-ray tube, a plasma source (laser-plasma or dense plasma), or a capillary discharge source. During an SAXS operation, x-ray source 710 generates an x-ray beam 750 that comprises a set of diverging x-rays, as indicated by an initial beam portion 751. Transmissive x-ray optical element 720 intercepts beam portion 751 and reshapes it into a collimated beam portion 752 that is directed onto a thin film region 741 on test sample 742. The scattering distribution of x-ray set 770 (with individual x-rays 771, 772, and 773 shown for explanatory purposes) is then measured by detector 730. An optional transmissive x-ray optical element 721 can be placed in the path of the set of scattered x-rays 730 to enhance the resolving power of detector 730, as described above with respect to FIG. 5. The measurement data from detector 730 can then be stored or processed by optional computer 790 to determine the desired characteristics of thin film region 741.

Figure 8A:
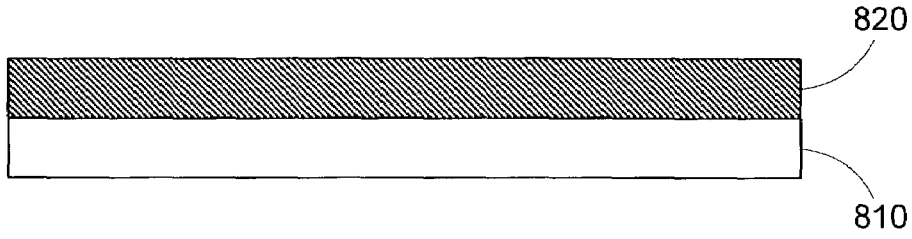
FIGS. 8*a*, 8*b*, 8*c*, 8*d*, 8*e*, 8*f*, 8*g*, 8*h*, and 8*i* are cross-sectional views showing a manufacturing process for a zone plate in accordance with an embodiment of the invention.
Figure 8B:
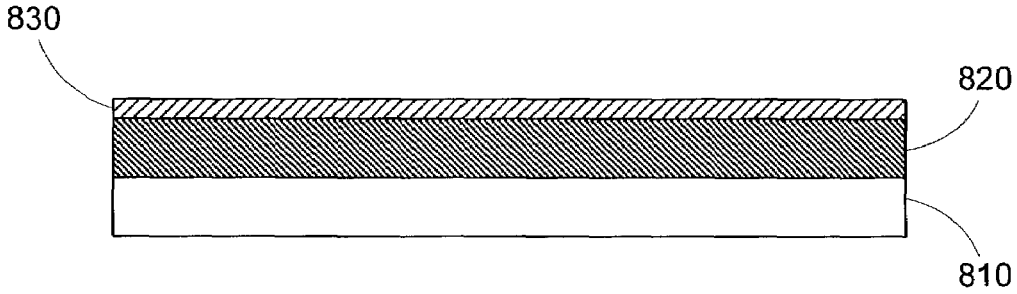
Figure 8C:
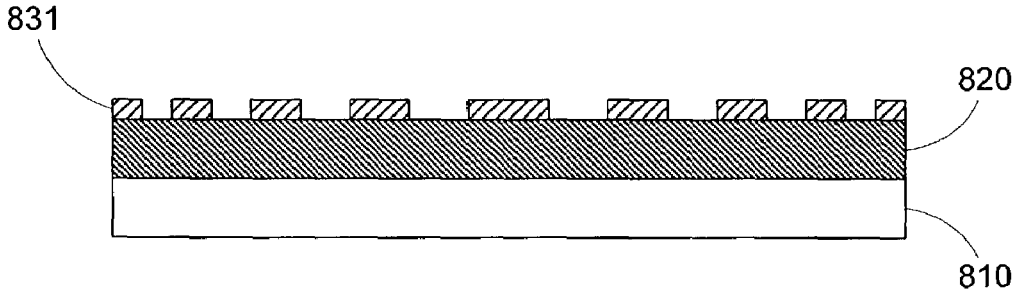
Figure 8D:
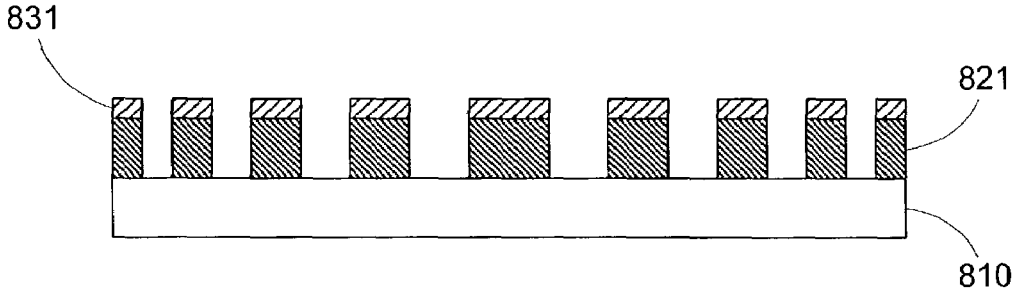

FIGS. 8*a*–8*i* show a method for fabricating a zone plate using a damascene process according to an embodiment of the invention. Referring to FIG. 8*a*, the fabrication process begins by forming a dielectric layer 820 on a substrate 810. Dielectric layer 820 can comprise elements having low atomic numbers (e.g., silicon (14) and lower) to minimize interaction with the x-rays of interest. According to various embodiments of the invention, dielectric layer 820 can comprise silicon dioxide (SiO2), silicon nitride (SiN), silicon carbide (SiC), or even a porous dielectric. In FIG. 8*b*, a resist layer 830 is formed over dielectric layer 820, and is then patterned with the desired concentric ring pattern to form a patterned resist layer 831 in FIG. 8*c*. According to an embodiment of the invention, the patterning operation can be performed using standard lithography techniques such as optical lithography (using optical proximity correction or phase shift masking) or electron beam lithography. Therefore, the dimensions of the final zone plate are only limited by the resolution limit of the lithography processes being used. Then in FIG. 8*d*, the exposed portions of dielectric layer are etched away to form a patterned dielectric layer 821 made up of concentric trenches of circular, elliptical, or other oval shapes.

Figure 8E:
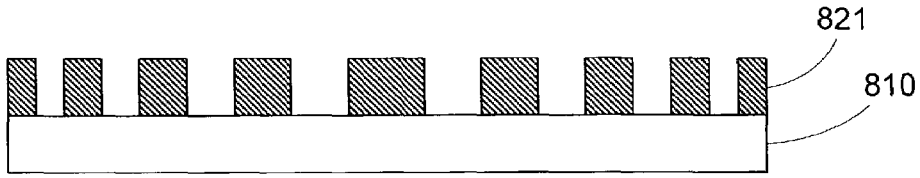
Figure 8F:
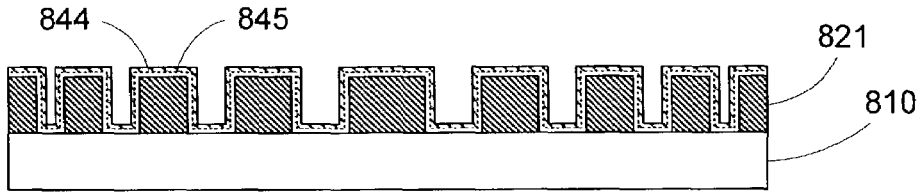
Figure 8G:
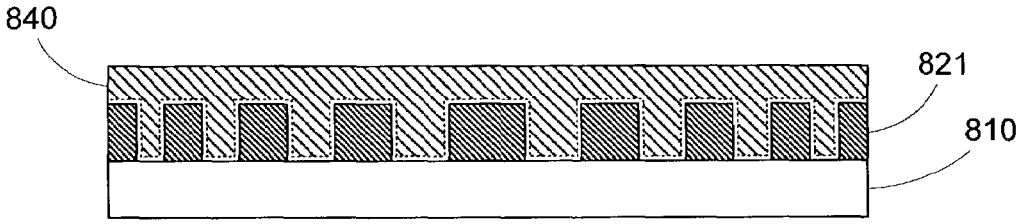
Figure 8H:
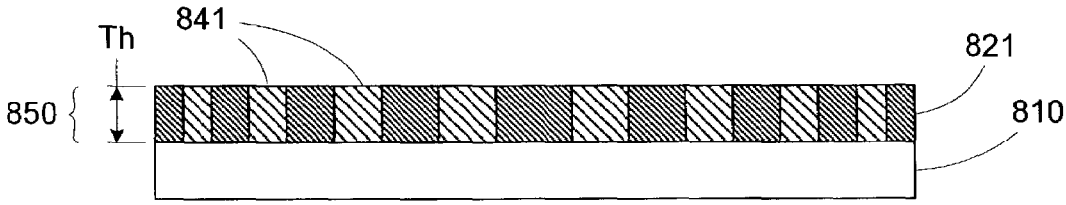

In FIG. 8*e*, an optional barrier layer 844 and a seed layer 845 are formed over the entire patterned region (i.e., patterned dielectric layer 821 and the exposed portions of substrate 810) using physical vapor deposition (PVD) or chemical vapor deposition (CVD). Then in FIG. 8*f*, a metal layer 840 is electro-chemically plated over seed layer 845. Note that if migration of the atoms of metal layer 840 is not a concern, then barrier layer 844 can be eliminated. According to various embodiments of the invention, metal layer 840 can comprise copper, tungsten, cobalt, or any other metal or metal compound compatible with the damascene process. Then, in FIG. 8*g*, the top portion of metal layer 840 is planarized via chemical-mechanical polishing (CMP) until patterned dielectric layer 821 is exposed, thereby forming a damascene layer 850 made up of patterned dielectric layer 821 and concentric metal rings 841. The metal rings will generally introduce significantly more phase shift to the transmitted x-rays than will the dielectric rings, and the thickness Th of damascene layer 850 is selected to ensure proper constructive interference of the x-rays that exit the metal and dielectric rings. FIG. 9 shows a plan (top) view of damascene layer 850, which clearly reveals the concentric rings formed by the damascene process. The performance of a zone plate including damascene layer 850 can be optimized by sizing concentric metal rings 841 and dielectric spacer rings 821 such that they all have the same plan view areas. Equal plan areas ensures complete constructive and destructive interference from the metal and dielectric rings, respectively.

Figure 8I:
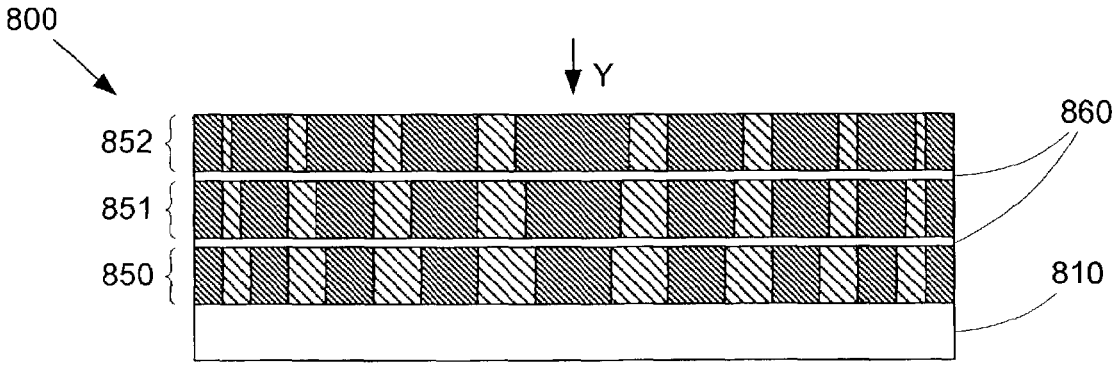

To complete the zone plate, additional damascene layers are then formed over damascene layer 850 using substantially the same processes (described with respect to FIGS. 8*a*–8*h*) used to form damascene layer 850. FIG. 8*i* shows a completed zone plate 800 that includes damascene layers 850, 851, and 852, formed one over the other, and separated by dielectric layers 860 (e.g., silicon nitride). By "stacking" damascene layers in this manner, high aspect ratio metal structures can be created in a very structurally sound manner. Note that while the outer diameters of corresponding metal rings in each damascene layer are aligned, the inner diameter of corresponding metal rings in each damascene layer get progressively larger in each successive damascene layer, so that the width of corresponding metal rings decreases in each successive damascene layer. This width variance creates the angled profile metal structures required to provide the desired x-ray beam shaping. For example, for a beam traveling in the Y direction, the metal rings of damascene layers 852, 851, and 850 will tend to cause the x-rays exiting the zone plate to converge (i.e., the x-ray beam will be focused (or collimated if the original x-rays entering the zone plate were diverging)). Note that the x-rays in an x-ray beam traveling in the opposite direction through zone plate 800 (i.e., in the negative Y direction) would be affected in the same manner—i.e., the exiting x-rays would also converge. Note that while increasing metal ring inner diameters in damascene layers 850–852 are shown in FIG. 8*i* for explanatory purposes, according to other embodiments of the invention, the metal ring inner diameters can decrease in successive damascene layers, or the outer diameters of the metal rings can be increased or decreased (while holding the inner diameters constant between damascene layers) to provide the desired beam shaping. The details of how the rings in different levels change in thickness and position affect the intensity of various orders of diffraction and can be tailored to ensure that the great majority of x-rays diffract into the desired order. When tailored in this way, the zone plate will have maximum efficiency and contrast. According to various other embodiments of the invention, different dielectric materials and different metals can be used in (and/or between) the different damascene layers to adjust the overall beam shaping properties of zone plate 800. Note that while three damascene layers are shown in FIG. 8*i* for explanatory purposes, a zone plate in accordance with the invention can include any number of damascene layers.

Figure 10:
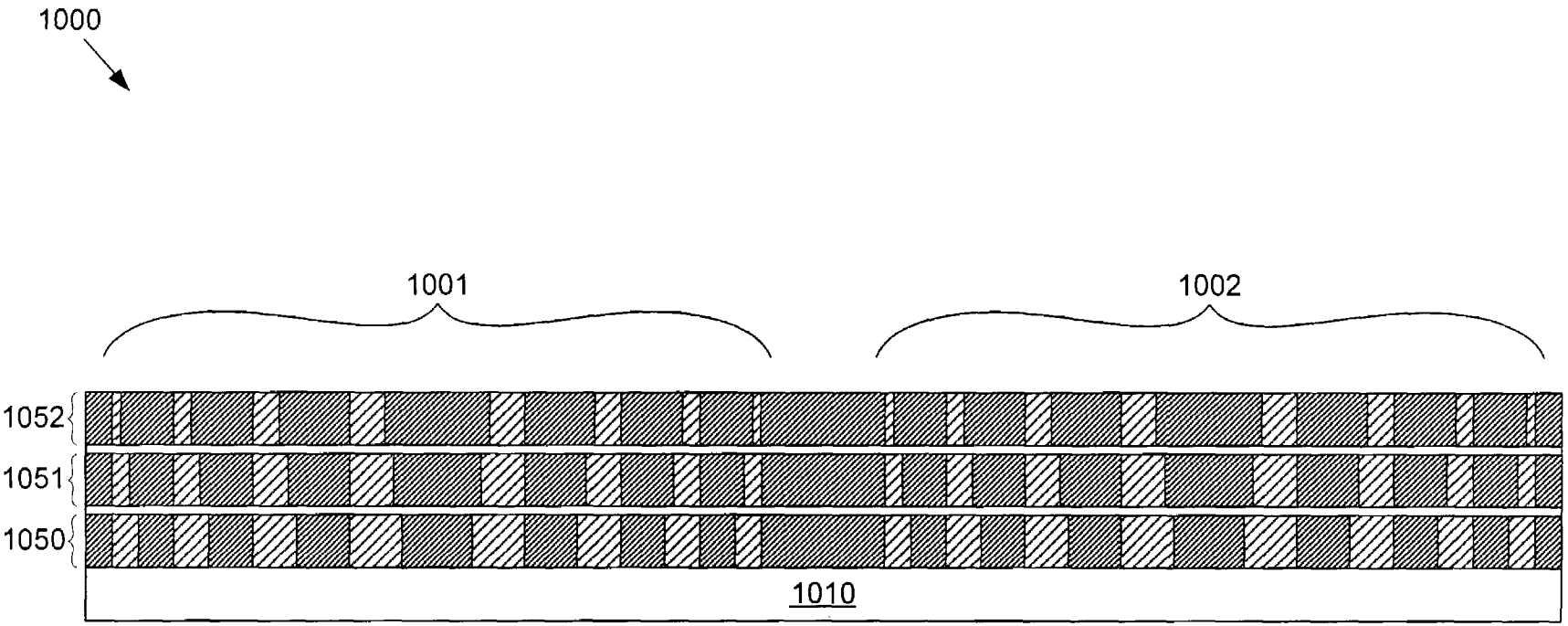
FIG. 10 is a cross sectional view of a zone plate in accordance with another embodiment of the invention.

FIG. 10 shows a zone plate 1000 in accordance with another embodiment of the invention. Zone plate 1000 includes three damascene layers 1050, 1051, and 1052, each of which is substantially similar to damascene layers 850, 851, and 852, respectively, shown in FIG. 8*i*, except that each of damascene layers 1050, 1051, and 1052 includes two sets of concentric metal rings. Therefore, zone plate 1000 includes two diffraction grating regions 1001 and 1002, each of which is substantially similar to zone plate 800 shown in FIG. 8*i*. Because diffraction grating regions 1001 and 1002 can be formed simultaneously on the same substrate 1010 (using substantially the same process described with respect to FIGS. 8*a*–8*i*), zone plate 1000 effectively provides a zone plate array that can be efficiently and accurately manufactured. Note that while two diffraction grating regions having three damascene layers each are shown in FIG. 10 for explanatory purposes, a zone plate in accordance with the invention can include any number of diffraction grating regions, with each of the diffraction grating regions having any number, type, and configuration of damascene layers.

The various embodiments of the structures and methods of this invention that are described above are illustrative only of the principles of this invention and are not intended to limit the scope of the invention to the particular embodiments described. Thus, the invention is limited only by the following claims.

The invention claimed is:

1. An x-ray metrology system comprising:

an x-ray source for simultaneously generating a first x-ray beam and a second x-ray beam, each originating from a different spatial location in the source;

a first zone plate for reshaping the first x-ray beam into a first reshaped beam portion, the first reshaped beam portion comprising a first plurality of converging x-rays focused onto a measurement spot on a first surface of a test sample; and a second zone plate for reshaping the second x-ray beam into a second reshaped beam portion, the second reshaped beam portion comprising a second plurality of converging x-rays focused onto the same measurement spot on the first surface of the test sample, wherein the first and second zone plates are formed on a single substrate and simultaneously focus a same wavelength.

2. An x-ray metrology system comprising:

an x-ray source for simultaneously generating a first x-ray beam and a second x-ray beam, each originating from a different spatial location in the source;

a first transmissive x-ray optical element for reshaping a portion of the first x-ray beam and directing a first reshaped beam at an area of a test sample;

a second transmissive x-ray optical element for reshaping a portion of the second x-ray beam and directing a second reshaped beam at the area of the test sample, wherein the first and second transmissive x-ray optical elements operate in a parallel plane; and a detector for simultaneously taking multiple incident beam angle measurements on output x-rays to determine specified characteristics of the test sample.

3. The x-ray metrology system of claim 2, wherein the first transmissive x-ray optical element includes a zone plate.

4. The x-ray metrology system of claim 2, wherein the second transmissive x-ray optical element includes a zone plate.

5. The x-ray metrology system of claim 2, wherein the first transmissive x-ray optical element and the second transmissive x-ray optical element are formed on a single substrate.

6. An x-ray metrology system comprising:

an x-ray source for generating a first x-ray beam;

a multi-layer zone plate having multiple zone plates formed on a single substrate and operating in series, the multi-layer zone plate for reshaping a first portion of the first x-ray beam to generate a reshaped beam portion, wherein the reshaped beam portion comprises a plurality of collimated x-rays directed onto a test sample, a thin film on the test sample scattering a first portion of the plurality of collimated x-rays as a set of scattered x-rays; and a first detector for measuring the set of scattered x-rays.

7. The x-ray metrology system of claim 6, wherein each zone late is separated from an adjacent zone plate using a layer conducive to propagating x-rays.

8. The x-ray metrology system of claim 6, further comprising a computer, wherein the computer includes logic for analyzing scattering distributions measured by the first detector to perform small angle x-ray scattering operations.

9. The x-ray metrology system of claim 6, wherein the thin film comprises a porous dielectric material.

10. A method for performing x-ray metrology comprising:

generating first and second x-ray beams;

reshaping the first x-ray beam into a first reshaped beam using a first transmissive zone plate;

simultaneously reshaping the second x-ray beam into a second reshaped beam using a second transmissive zone plate formed on a same substrate as the first transmissive zone plate, the first and second transmissive zone plates focusing a same wavelength;

directing the first and second reshaped beams at a same measurement spot on the same surface of a test sample to generate a plurality of output x-rays; and taking multiple incident beam angle measurements on the output x-rays to determine specified characteristics of the test sample.

11. A method for performing x-ray metrology comprising:

generating a source x-ray beam;

reshaping a first portion of the source x-ray beam into a first reshaped beam portion using a multi-layer zone plate having multiple zone plates formed on a single substrate and operating in series;

directing the first reshaped beam portion at a first surface of a test sample to generate a plurality of output x-rays; and taking measurements on the output x-rays to determine specified characteristics of the test sample, wherein the first portion of the source x-ray beam comprises a plurality of diverging x-rays, and wherein reshaping the first portion of the source x-ray beam comprises diffracting the plurality of diverging x-rays using the multi-layer zone plate into a plurality of collimated x-rays.

12. The method of claim 11, wherein the each of the plurality of output x-rays comprises one of the plurality of collimated x-rays scattered by the test sample, and wherein taking measurements on the plurality of output x-rays comprises focusing the plurality of output x-rays onto a detector using a transmissive x-ray optical element.

* * * * *